United States Patent [19]

Post, Jr.

[11] Patent Number: 4,888,923

[45] Date of Patent: Dec. 26, 1989

[54] CUPOLA MOUNT

[76] Inventor: Russell H. Post, Jr., 162 Kingston Rd., Kingston, N.H. 03848

[21] Appl. No.: 131,013

[22] Filed: Dec. 10, 1987

[51] Int. Cl.[4] ..... E04B 7/18

[52] U.S. Cl. ..... 52/200; 285/44

[58] Field of Search ..... 52/72, 200, 199; 98/46, 98/42.2, 42.21; 285/44

[56] References Cited

U.S. PATENT DOCUMENTS

| | | | |
|---|---|---|---|
| 1,322,711 | 11/1919 | Maranville | 98/46 |
| 3,216,161 | 11/1965 | Forsman | 285/44 |
| 3,742,659 | 7/1973 | Drew | 52/199 |

*Primary Examiner*—James L. Ridgill, Jr.

*Attorney, Agent, or Firm*—Lee A. Strimbeck

[57] ABSTRACT

A prefabricated cupola and the like for mounting over a roof ridge comprises a rectangular body and a mounting bracket. The mounting bracket comprises two clamshell like opposed cylindrical segments that fit under the bottom edges of and fill the gaps beneath the outer walls of the rectangular body when it is centered on the ridge line. The mounting bracket is preferably attached for pivotal motion to the interior bottom edges of the walls straddling the roof ridge. The arms of the cylindrical segments fill the triangular gasp beneath the straddling walls.

6 Claims, 2 Drawing Sheets

CUPOLA MOUNT

Figure 1:
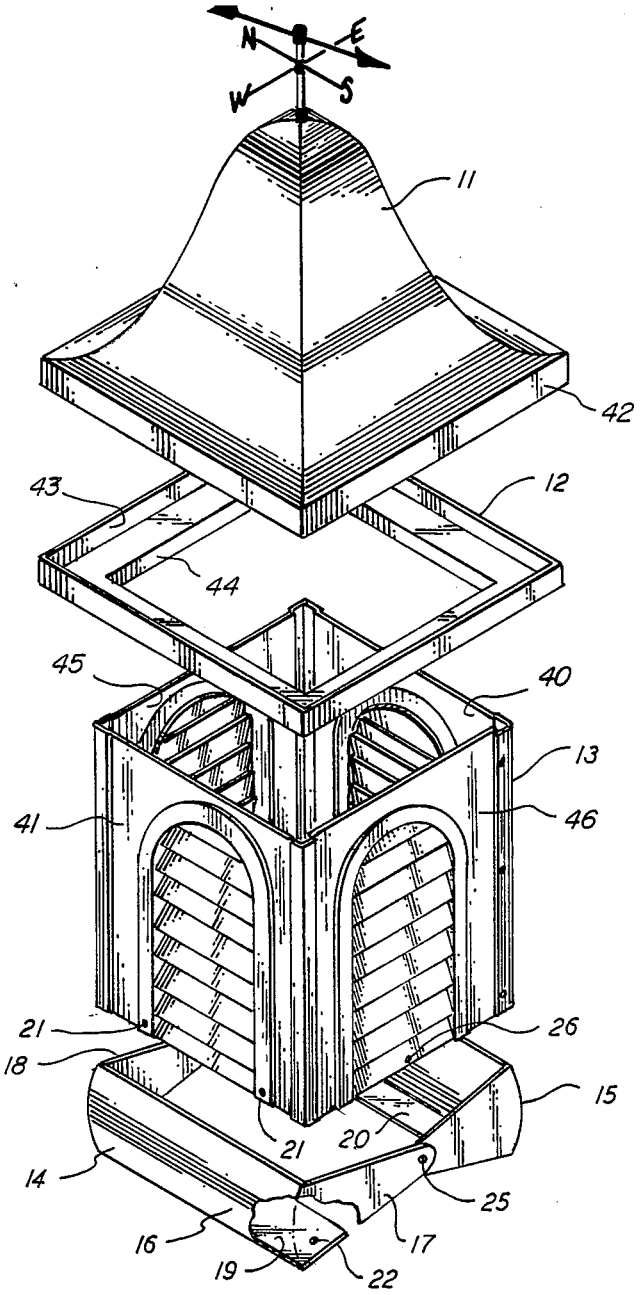

This invention is a method and mounting system for attaching a square cupola, false chimney and the like to a roof. This method permits the attachment of a prefabricated rectangular structure over the ridge of a roof quickly and easily with a minimum of installation time.

INTRODUCTION

In modern construction to save labor and installation costs, many components are prefabricated and designed for ready installation. It is often desired to add decorative touches to a house, barn and other structures by placing a cupola on a roof or affixing a false chimney, as over a stove flue. Such rectangular structures are less expensive if they are prefabricated. However, it is difficult to prefabricate a structure that can be quickly mounted and made to conform to the many various pitches roofs have without leaving an unsightly gap.

The present invention is addressed to this problem.

THIS INVENTION

The present invention proposes a prefabricated rectangular structure such as a square cupola or a false chimney that has adjustable mounting means at the bottom edges, permitting it to be readily mounted over a roof ridge without leaving an unsightly gap.

While the prefabricated structures can be made in a conventional manner from wood, such as a thin plywood, is preferred to make them of a relatively thin walled plastic, especially the mounting means herein proposed. The exterior of the plastic is molded and colored to give the appearance of a traditional cupola, brick or stone chimney or the like. The plastic can be any of the conventional weather - resistant plastics such as: ABS, vinyl, polypropylene homo or copolyomer, epoxy/fiberglass lay-up and the like. The plastic can be fabricated by spraying, vacuum forming, compression molding and other known procedures.

In brief compass, this invention is a rectangular structure and associated mounting brackets mountable on a roof ridge. The rectangular structure is a hollow rectangular body having two opposing side walls to be parallel to the line of the ridge, the bottom edges of which when said rectangular body is positioned on the roof ridge, do not reach the roof, leaving gaps therebetween. The mounting bracket comprising two opposed hollow cylindrical segments operating in a clam shell fashion, which segments fill the gaps. The cylindrical segments are coextensive and mate with the bottom edges of the two walls parallel to the ridge line. The clam shell portions, when lowered, cover the gaps. The arms of the clam shell portions are radial segments i.e., pie-shaped pieces, of the end walls of the cylindrical segments and are preferably attached for pivotal motion to each other and also to the center bottom edges of the walls of the rectangular structure that straddle the ridge. The arms mate with the roof and cover the triangular gaps under the ridge-straddling walls.

The prefabricated structure has means for attaching the cylindrical segments to the roof, such as a mounting strip running along the lower edge of each cylindrical segment between the arcuate end portions through which screws can be run. There are also means for fixing the cylindrical portions to the main body of the ractangular structure to prevent relative motion therebetween. e.g., screws or bolts are provided that run through the lower edge of the rectangular side walls into the cylindrical segment once it is in place rigidly affixing the two together.

THE DRAWINGS

Figure 2:
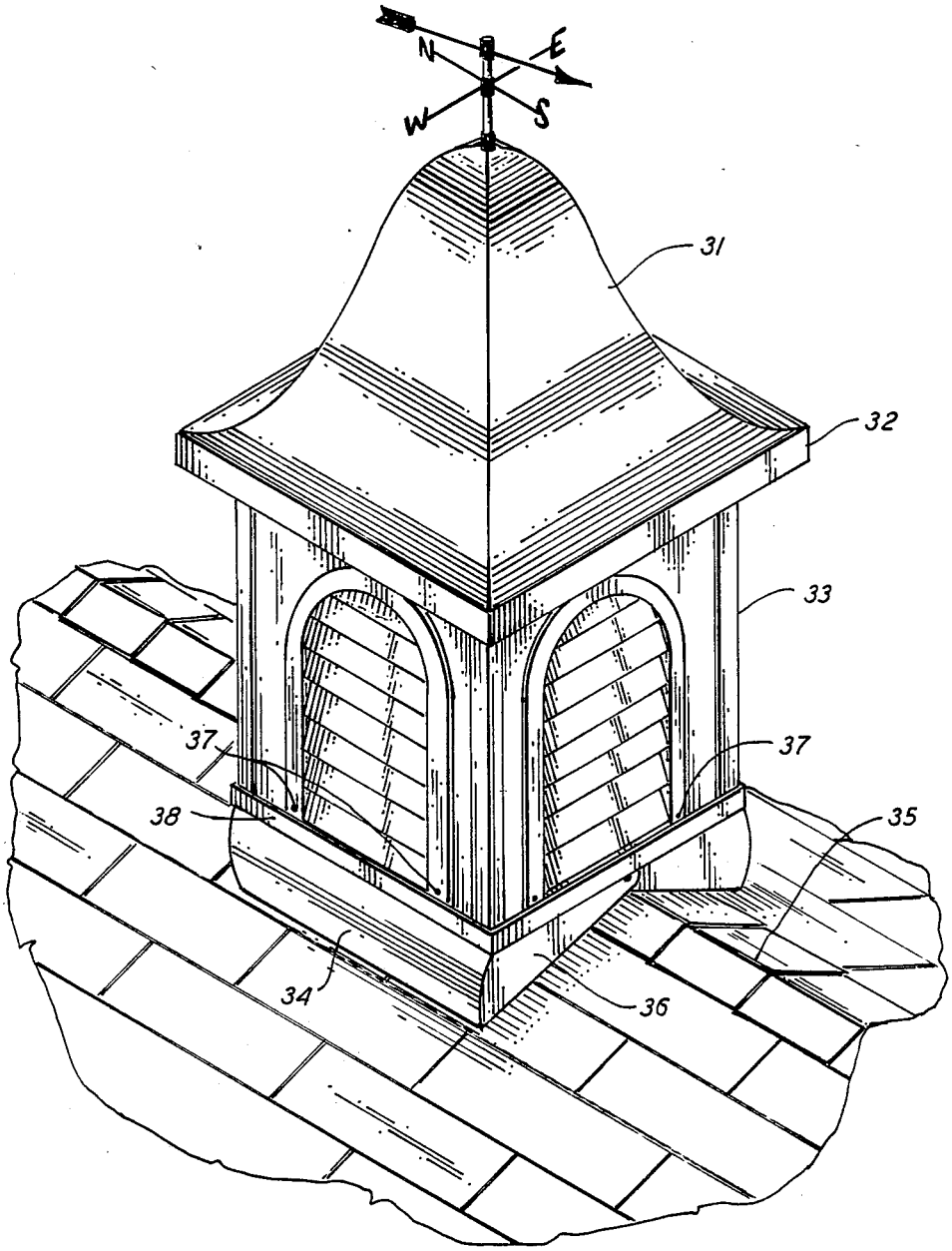

In the drawings:

FIG. 1 is a perspective exploded assembly view of a prefabricated cupola designed in accordance with the teachings of this invention; and FIG. 2 is a perspective view of a cupola of this invention mounted on a roof ridge.

DESCRIPTION

With reference to FIG. 1 the prefabricated cupola of this invention consists of a roof 11 a connecting frame 12, a rectangular body 13 and as mounting brackets clam shell portions 14 and 15. The roof 11 maybe of a plastic 0.125 inches thick and copper colored.

The cupola roof extends over all four sides of body 13. Body 13 has 2 opposing side walls 40, 41, that will parallel the ridge line, referred to as the first walls hereafter, and two opposing side walls 45 and 46 that will straddle the ridge, referred to hereafter as the second walls. The bottom edges of the first walls when the rectangular body 13 is positioned on the ridge will not reach the roof sloping away from ridge leaving gaps between the bottom edges of the first walls and the roof.

Frame 12 can be of a plastic 0.100 inches thick with an upturned outer rim 43 that mates with the inside of a corresponding downturned rim 42 on all four sides of roof 11. Frame 12 has an inner downturned rim 44 that mates with the inside top edges of walls 40, 41, 45 and 46. the rims 42 and 43 may be about 16 inches on a side and rim 44 can provide an approximately 12 inch square central opening to engage the interior of body 13.

Body 13 can be of a molded plastic 0.100 inches thick and as illustrated can have simulated louvers and louver frames molded therein. Body 13 can be 12 inches high and 12 inches square to mate with rim 44.

The mirror-image clam shell portions 14 and 15 are mounted together for pivotal motion by their radial segment end walls 17, 18, and 40 (one end wall not being visible) on their axis of rotation at 25. They may also be attached at 26 on the center line of the opposing walls of the cupola proximate the bottom edges thereof. The mounting brackets with reference to item 14 consists in more detail of a cylindrical segment 16 having arcuate pie-shaped end walls 17 and 18, end wall 17 being broken away to show an interior flat mounting strip 19 attached to the bottom edge of segment 16 and to walls 17 and 18. Mounting strips 19 and 20 of claim shell section 15 and 16 are referred to in the claims as "first means for attaching the cylindrical segments". Screws 22 can be passed through strip 19 to attach the mounting bracket to the roof. The mounting bracket if not hinged to the body can first be attached to the roof and the body 13 then slipped over and fastened to it.

Once the mounting brackets are installed holes maybe drilled through the cylindrical portions 16 to mate with the holes 21 of body 13 after which screws or bolts are placed therethrough to tie the two together and firmly mount the body to the mounting brackets. However, if a sharp screw is used, it will penetrate the plastic and no drilling will be required. The screws and holes 21 are referred to in the claims as the "second means for affixing the cylindrical segments." The connector frame and roof are then placed on the body and attached by suitable screws or bolts in a conventional manner (not shown).

A complete mounted cupola is shown in FIG. 2. The cupola is mounted on roof ridge 35. The cupola roof is shown at 31, the body at 33 and one of the mounting brackets at 34. The connector frame cannot be seen. The arcuate portion 36 of the mounting bracket fills the triangular gap between the flat edge of the wall of the body 33 and the roof and the curvilinear or cylindrical portion of the mounting bracket 34 fills the gap between the bottom of the wall of the cupola that is parallel to the ridge line. Once positioned on the mounting brackets, the body is attached to the mounting bracket by bolts 37.

The mounting brackets present a curved surface to the eye underneath the lower edge of body (where the reference numeral 34 is), which should be a flat wall for a conventional cupola placement. However, even for 12/12 pitch, with a 16 inch square cupola, this gap is only about 11/2 inches and when viewed from a distance, the curved surface is hardly noticeable. This curved surface can be masked somewhat by placing a square molding 38 about the base of the body 33. Also the bottom edge of body 13 can be molded to have a convex surface that mates with the exterior face of bracket 34.

What is claimed:

1. A cupola assembly mountable on a ridge of a roof comprising:

a hollow rectangular body having two opposing side walls, said first walls hereafter, to be parallel to the line of said ridge, the bottom edges of which when said rectangular body is positioned on said ridge not reaching said roof leaving gaps therebetween, and having two opposing walls, said second walls hereafter, that are to straddle said ridge;

opposed clam shell cylindrical segments the cylindrical portions thereof being coextensive and mating with the bottom edges of said first walls and filling said gaps when the assembly is completed;

a cupola roof extending over all four sides of said hollow rectangular body and having a downturned rim on all four sides:

a connecting rectangular frame having (a) an outer upturned rim mating with the inside of said downturned rim and (b) a downturned inner rim that mates with the inside top interior edges of said first and second walls;

first means for attaching the cylindrical segments to said roof; and second means for affixing the cylindrical segments to said rectangular body and preventing relative motion therebetween.

2. The rectangular assembly of claim 1 when said first means for attaching comprises mounting strips along the bottom edges of each cylindrical segments extending the length thereof and adapted to receive mounting screws.

3. The rectangular assembly of claim 2 wherein said second means includes screws passing through said first walls into the cylindrical segments when said clam shell cylindrical segments are in position thereby locking the same.

4. The rectangular assembly of claim 3 wherein said clam shell cylindrical segments have pie-shaped end portions which fill the gaps beneath said second walls and the roof when the assembly and mounting are complete.

5. A cupola having a quick mount for attachment to a roof ridge with the walls thereof being vertical, comprising:

a hollow rectangular body;

a cylindrical segment coextensive with the bottom edge of one wall of said rectangular body and having an arcuate arm at each end;

said cylindrical segment being mounted for rotation by said arcuate arms on the two opposed side walls of said rectangular body perpendicular to said one wall;

a cupola roof extending over all our sides of said hollow rectangular body and having a downturned rim on all four sides;

a connecting rectangular frame having (a) an outer upturned rim mating with the inside of said downturned rim and (b) a downturned inner rim that mates with the inside top interior edges of said hollow rectangular body;

first means for attaching the cylindrical segment to said roof; and second means for affixing the cylindrical segment to said hollow rectangular body and preventing relative motion therebetween.

6. The rectangular structure and quick mount of claim 5 having two opposing cylindrical segments, the arcuate arms of which are mounted for pivotal motion on the center line of said opposed side walls near the bottom edges thereof.

* * * * *